US012102140B2

(12) United States Patent
Lee

(10) Patent No.: US 12,102,140 B2
(45) Date of Patent: Oct. 1, 2024

(54) SUPPORTIVE UNDERGARMENT AND SPORTS BRA SYSTEM

(71) Applicant: Heather Lee, Studio City, CA (US)

(72) Inventor: Heather Lee, Studio City, CA (US)

( * ) Notice: Subject to any disclaimer, the term of this patent is extended or adjusted under 35 U.S.C. 154(b) by 379 days.

(21) Appl. No.: 17/124,683

(22) Filed: Dec. 17, 2020

(65) Prior Publication Data

US 2021/0186125 A1 Jun. 24, 2021

Related U.S. Application Data

(60) Provisional application No. 62/950,332, filed on Dec. 19, 2019.

(51) Int. Cl.
*A41C 3/00* (2006.01)
*A41C 3/10* (2006.01)

(52) U.S. Cl.
CPC ..... *A41C 3/0021* (2013.01); *A41C 3/10* (2013.01)

(58) Field of Classification Search
None
See application file for complete search history.

(56) References Cited

U.S. PATENT DOCUMENTS 3,297,035 A 1/1967 Wright
3,302,649 A * 2/1967 Bruno ..... A41F 1/006 450/63
4,202,343 A 5/1980 Ichelson
4,292,975 A 10/1981 Champion et al.
4,444,191 A 4/1984 Harned
4,530,361 A * 7/1985 Wooten ..... A41C 3/0028 450/59
4,655,224 A * 4/1987 Stern ..... A41C 3/00 450/67
4,832,053 A 5/1989 McCarthy
4,878,879 A 11/1989 Kunstadter
5,873,768 A * 2/1999 Fleischman-Ament ..... A41C 3/0071 450/67
6,280,287 B1 * 8/2001 Keith ..... A41F 15/002 450/41
6,755,717 B2 6/2004 Smith
7,628,675 B2 12/2009 Staub
7,909,675 B1 3/2011 Rainey
10,244,801 B2 4/2019 Witek et al.
(Continued)

FOREIGN PATENT DOCUMENTS

ES 1057135 6/2004

OTHER PUBLICATIONS

International Search Report and Written Opinion in corresponding PCT/US2020/065486, dated Mar. 10, 2021.

*Primary Examiner* — Jocelyn Bravo
(74) *Attorney, Agent, or Firm* — Hovey Williams LLP

(57) ABSTRACT

A supportive undergarment configured to restrain movement of breast tissue in the superior direction is provided. The undergarment is configured to be used in conjunction with a conventional bra, especially an underwire-containing sports bra, without unnecessarily duplicating the support provided by the bra. The undergarment comprises a pair of supporting straps that are releasably anchored to the undergarment's lower circumscribing band via at least one anchor member. The supporting straps are configured to provide compression to the wearer's upper breast roots and arrest upward movement of the wearer's breasts.

22 Claims, 9 Drawing Sheets

(56) References Cited

U.S. PATENT DOCUMENTS

| | | | | |
|---|---|---|---|---|
| 2001/0019933 | A1* | 9/2001 | Wagner | A41C 3/0057 450/37 |
| 2004/0058618 | A1* | 3/2004 | Yang | A41C 3/0071 450/38 |
| 2006/0252346 | A1* | 11/2006 | Reinisch | A41C 3/0028 450/86 |
| 2009/0053975 | A1* | 2/2009 | Nuzzo | A41C 3/0028 450/75 |
| 2009/0233522 | A1 | 9/2009 | Schlatmann | |
| 2010/0317257 | A1 | 12/2010 | Campbell | |
| 2011/0177757 | A1* | 7/2011 | Swendseid | A41C 3/0057 2/113 |
| 2012/0244782 | A1* | 9/2012 | Pundyk | A41C 3/0057 450/70 |
| 2013/0115852 | A1 | 5/2013 | Blackwell | |
| 2013/0225043 | A1 | 8/2013 | Musarra-Leonard | |
| 2013/0316616 | A1 | 11/2013 | Thompson | |
| 2016/0015090 | A1* | 1/2016 | Mazourik | A41C 3/0071 450/55 |
| 2018/0184726 | A1 | 7/2018 | Wesley | |
| 2019/0098940 | A1* | 4/2019 | Huffa | A41C 3/124 |
| 2019/0150525 | A1* | 5/2019 | Arshava | A41C 3/0064 |

* cited by examiner

SUPPORTIVE UNDERGARMENT AND SPORTS BRA SYSTEM

RELATED APPLICATION

This application claims the benefit of U.S. Provisional Patent Application No. 62/950,332, filed Dec. 19, 2019, which is incorporated by reference herein in its entirety.

BACKGROUND OF THE INVENTION

Field of the Invention

The present invention is generally directed toward an undergarment configured to restrain upward movement of the wearer's breast while the wearer engages in various physical activities, such as athletics or horseback riding, that might otherwise subject the wearer to discomfort to due excessive bodily movement. The supportive undergarment is configured to be worn in conjunction with, but remain independent from, a conventional bra, such as a sports bra.

Description of the Prior Art

Conventional bras are constructed to provide support to the wearer's breasts and help achieve a desired aesthetic appearance. As the woman's breast size increases, more support is required to achieve these objectives. Some bras, particularly those configured for women with larger bust sizes, comprise an underwire to provide cantilevered support for the wearer's breasts. Underwire bras can provide adequate support to the underside of the breast and restrain downward movement of the breast tissue during physical activities. Conventional bras may also comprise fabrics configured to restrain lateral movement of breast tissue. However, conventional bras generally do not provide much in the way of support that will restrain upward movement of the wearer's breast tissue. This further leads to the problem of downward movement of the breast tissue, from an elevated position due to unrestrained upward movement, thereby causing the breasts to "slam" down into the cantilevered bra support.

Sports bras were developed to provide compressive support for the wearer's breast and to inhibit breast movement during physical activities that might otherwise be uncomfortable for the wearer. Sports bras may also be constructed with an underwire to provide enhanced support restraining downward movement of the breast. However, for those with larger bust sizes, the compressive support provided for the upper margins of the breasts is generally inadequate as the wearer can still be subject to considerable discomfort when engaging in physical activities. The end result is that the motion of the breast tissue does not match up with the motion of the rest of the body, which can result in discomfort for the wearer.

To compensate, some women resort to wearing more than one sports bra at a time. However, while such can provide improved support, often such added support is merely redundant of the cantilevered and compressive support and fails to address upward movement of the breast tissue. Thus, this work around is still insufficient to prevent wearer discomfort and can actually cause the wearer some discomfort by providing double support in areas that do not require it and causing over-compression of the ribcage making breathing uncomfortable during exercise.

U.S. Patent Application Publication No. 2019/0098940 is directed toward a pressure-distributing undergarment that redirects momentum related to a wearer's accelerating movements. However, this undergarment is constructed as a single piece through a three-dimensional knitting process. While such a process allows for an undergarment with minimal seams and finishing, there is no adjustability to the amount of compression provided to specific portions of the wearer's breasts. Thus, what may be sufficient support for one type of activity could be insufficient for another type of activity.

U.S. Pat. No. 4,444,191 is directed toward jogging support garments for the upper female anatomy. While embodiments described in the '191 patent may permit some degree of compression adjustability, when worn by a woman with a large bust, to achieve the necessary compressive force to minimize breast tissue movement, the wearer's entire rib case is compressed which can affect the wearer's ability to breathe comfortably.

Therefore, a need exists in the art for a supportive undergarment that overcomes these shortcoming of convention bras and is capable of providing adequate support for the upper portions of the wearer's breasts and restrains the upward movement of the breast tissue during physical activities.

SUMMARY OF THE INVENTION

Embodiments of the present invention seek to overcome the shortcomings of the prior art and provide an undergarment that is configured to support to the upper margins of the wearer's breasts and restrain upward movement of breast tissue during physical activities.

According to one embodiment of the present invention there is provided a supportive undergarment comprising a front portion, a back portion, a lower band, at least one anchor member, and a pair of support strap sections.

According to another embodiment of the present invention there is provided a supportive undergarment comprising a front portion having a pair of breast-receiving sections configured to overlie at least a portion of a wearer's breasts, and a back portion configured to overlie the wearer's back. A lower band is attached to the front and back portions at a lower margin thereof. The lower band is positioned beneath the pair of breast-receiving sections and configured to circumscribe at least a portion of the wearer's rib cage. At least one anchor member is attached to the lower band at a location that is in between the pair of breast-receiving sections. The undergarment further comprises a pair of support strap sections, each of which have a fixed end that is secured to the front portion. The pair of the support strap sections are connectable to the at least one anchor member under tension.

According to yet another embodiment of the present invention there is provided a system for restraining movement of breast tissue. The system comprises a bra having a pair of cups that are configured to provide support to the lateral sides and undersides of a wearer's breasts and restrain lateral and downward movement thereof, and a supportive undergarment that is substantially independent of and configured to overlie or underlie the bra. The supportive undergarment is configured to restrain upward movement of the wearer's breasts and comprises a front portion having a pair of breast-receiving sections configured to overlie at least a portion of the wearer's breasts, a lower band attached to the front portion at a lower margin thereof and positioned beneath the pair of breast-receiving sections, and at least one anchor member attached to the lower band at a location that is in between the pair of breast-receiving sections. The supportive undergarment further comprises a pair of support strap sections, each of which has a fixed end that is secured to the front portion. The pair of support strap sections are connectable to the at least one anchor member under tension.

In still another embodiment of the present invention there is provided a method of restraining movement of breast tissue. The method comprises donning a supportive undergarment over or underneath a bra. The supportive undergarment comprises a front portion having two breast-receiving sections, and a lower band attached to the front portion and positioned below the two breast-receiving sections. The supportive undergarment further comprises at least one anchor member attached to the lower band at a location that is in between the two breast-receiving sections, and a pair of supportive strap sections. Each of the supportive strap sections has a fixed end secured to the front portion. The fixed ends are attached to the front portion at opposed outboard margins thereof and above the breast-receiving sections. The supportive strap sections are extended over the upper portions of the wearer's breasts. The supportive strap sections are anchored to the at least one anchor member while the supportive strap sections are under tension thereby providing compression to the upper portions of the wearer's breasts.

Figure 1:
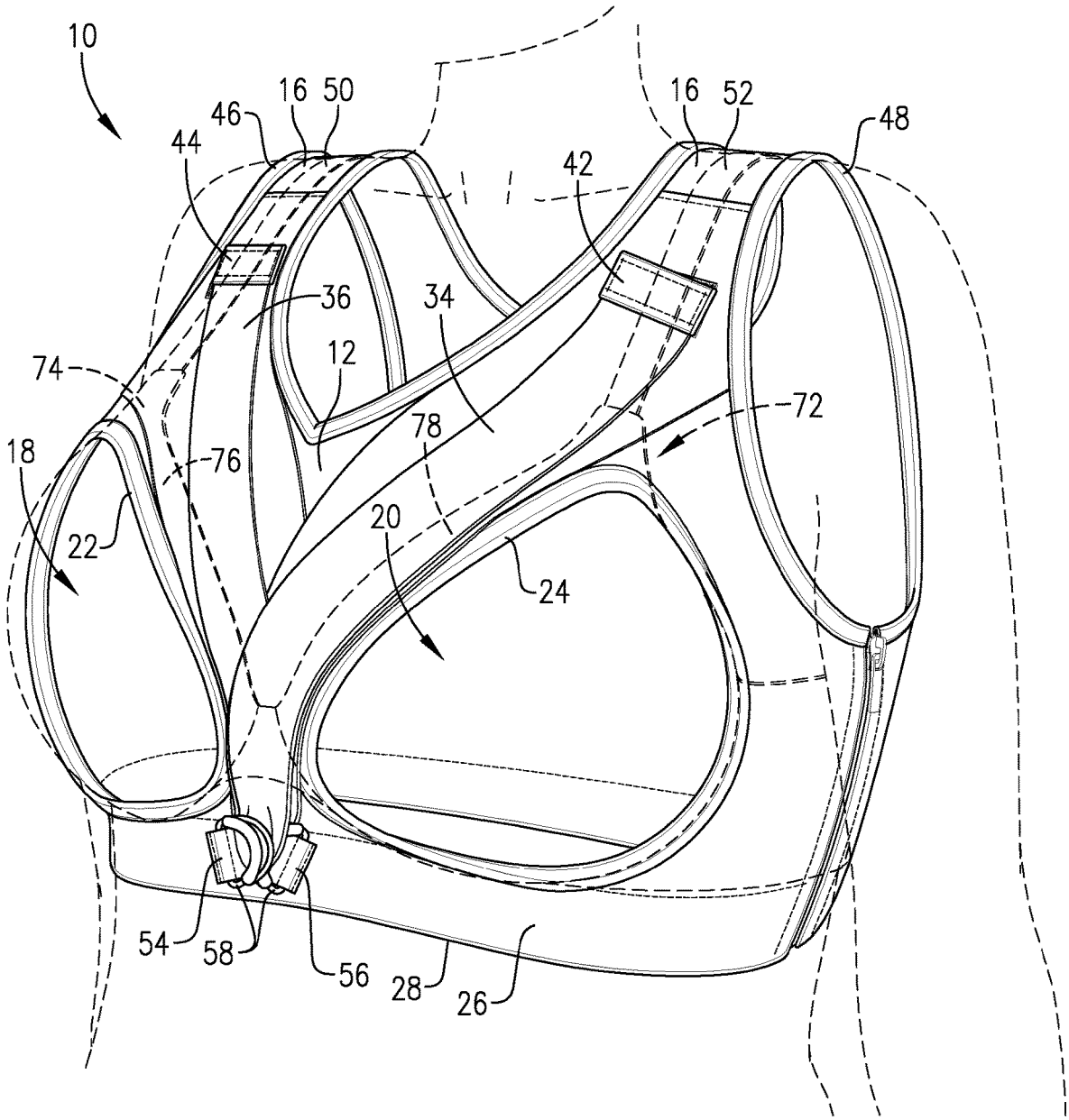
FIG. 1 is a front perspective view of a supportive undergarment according to the present invention being worn in conjunction with a conventional sports bra.

While the drawings do not necessarily provide exact dimensions or tolerances for the illustrated components or structures, the drawings are to scale with respect to the relationships between the components of the structures illustrated in the drawings.

DETAILED DESCRIPTION OF THE PREFERRED EMBODIMENT

Figure 2:
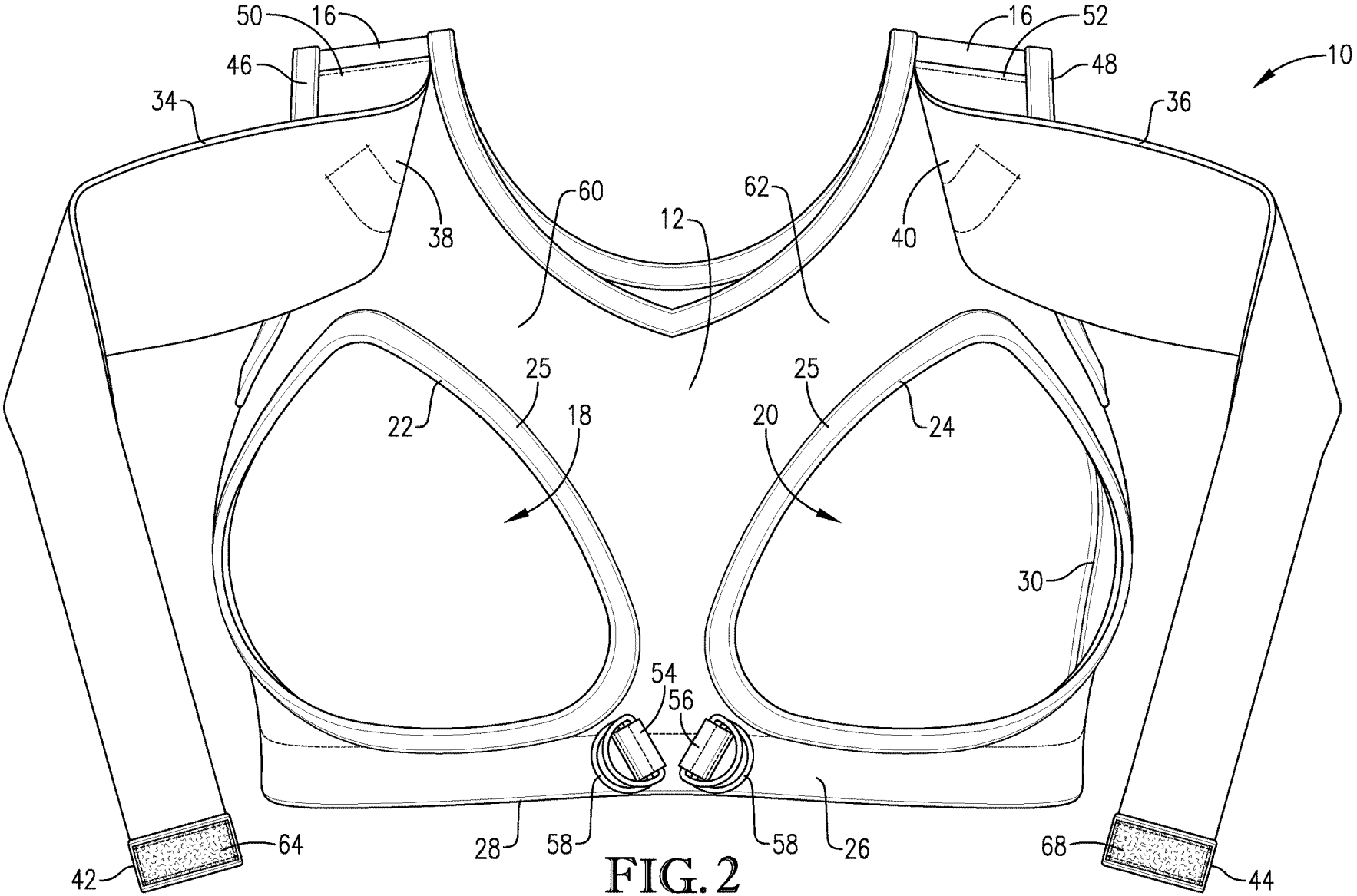
FIG. 2 is a front view of the supportive undergarment of FIG. 1, with the supportive straps unsecured.
Figure 3:
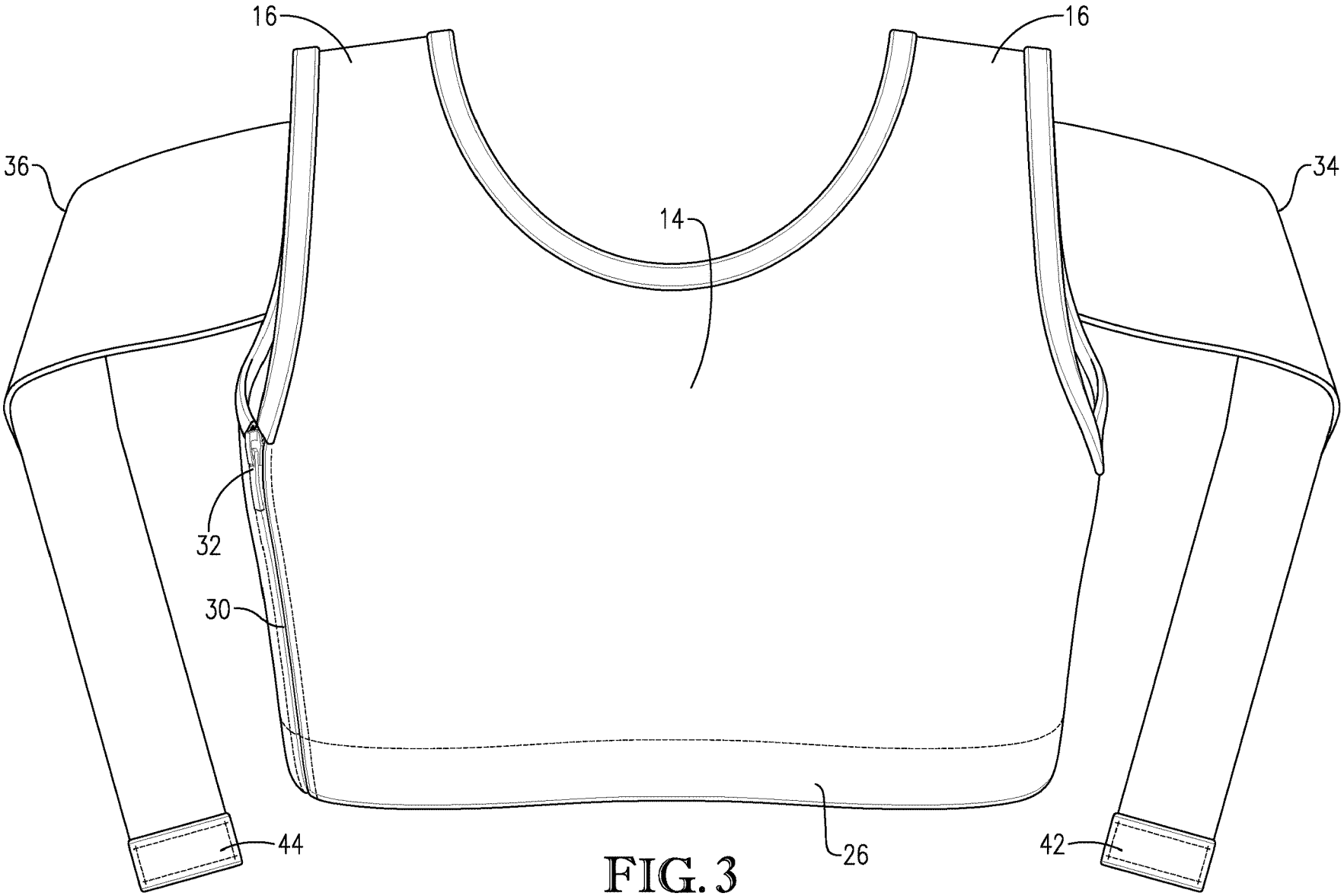
FIG. 3 is a back view of the supportive undergarment of FIG. 1.

Turning now to the Figures, and in particular to FIGS. 2 and 3, a supportive undergarment made in accordance with the concepts of the present invention 10 is illustrated. Undergarment 10 generally comprises a front portion 12 adapted to be worn over the wearer's chest, and a back portion 14 adapted to be worn over the wearer's back. The front and back portions cooperatively define a pair of shoulder straps 16 configured to be worn over the wearer's shoulders. It is noted that front and back portions 12, 14 may be formed from separate sheets of fabric that are stitched together, or the portions may comprise a single woven piece of fabric and the portions comprise sections of the single woven piece that are configured to overlie front and back portions of the wearer's body. It is further noted that neither the front nor back portions 12,14 must comprise a single, solid piece of fabric. Rather, it is within the scope of the present invention for either the front or back portions to be formed of various strips, straps (e.g., braided straps), cords or other structures that are commonly used in the garment industry.

In the illustrated embodiment, the front portion 12 comprises breast-receiving sections 18, 20 that are configured to overlie at least a portion of the wearer's breasts. In certain embodiments, sections 18, 20 may comprise cutouts that are defined by respective margins 22, 24. Margins 22, 24 may comprise fabric bands 25 that have been sewn to front panel 12 to prevent fraying of the fabric from which front panel 12 is comprised and/or to provide for the wearer's comfort. However, it is within the scope of the present invention for the breast-receiving sections 18, 20 to comprise fabric panels configured to cover the portions of wearer's breasts received in sections 18, 20. A lower band 26 is attached to the front and back portions at a lower margin 28 thereof. In certain embodiments, the lower band 26 may be sewn into or underneath the front and back portions 12, 14 so that the band material does not directly contact the wearer's body. Lower band 26 is positioned beneath breast-receiving sections 18, 20 and is configured to circumscribe at least a portion of the wearer's rib cage. Preferably, lower band 26 is constructed from a material having a relatively high tensile strength when compared to the material from which most front and back portions 12, 14 is comprised. As described in greater detail below, lower band 26 is configured to receive and distribute to the wearer's body various tensile forces acting within undergarment 10. In preferred embodiments, lower band comprises a mildly stretchable, elastic material.

Figure 4:
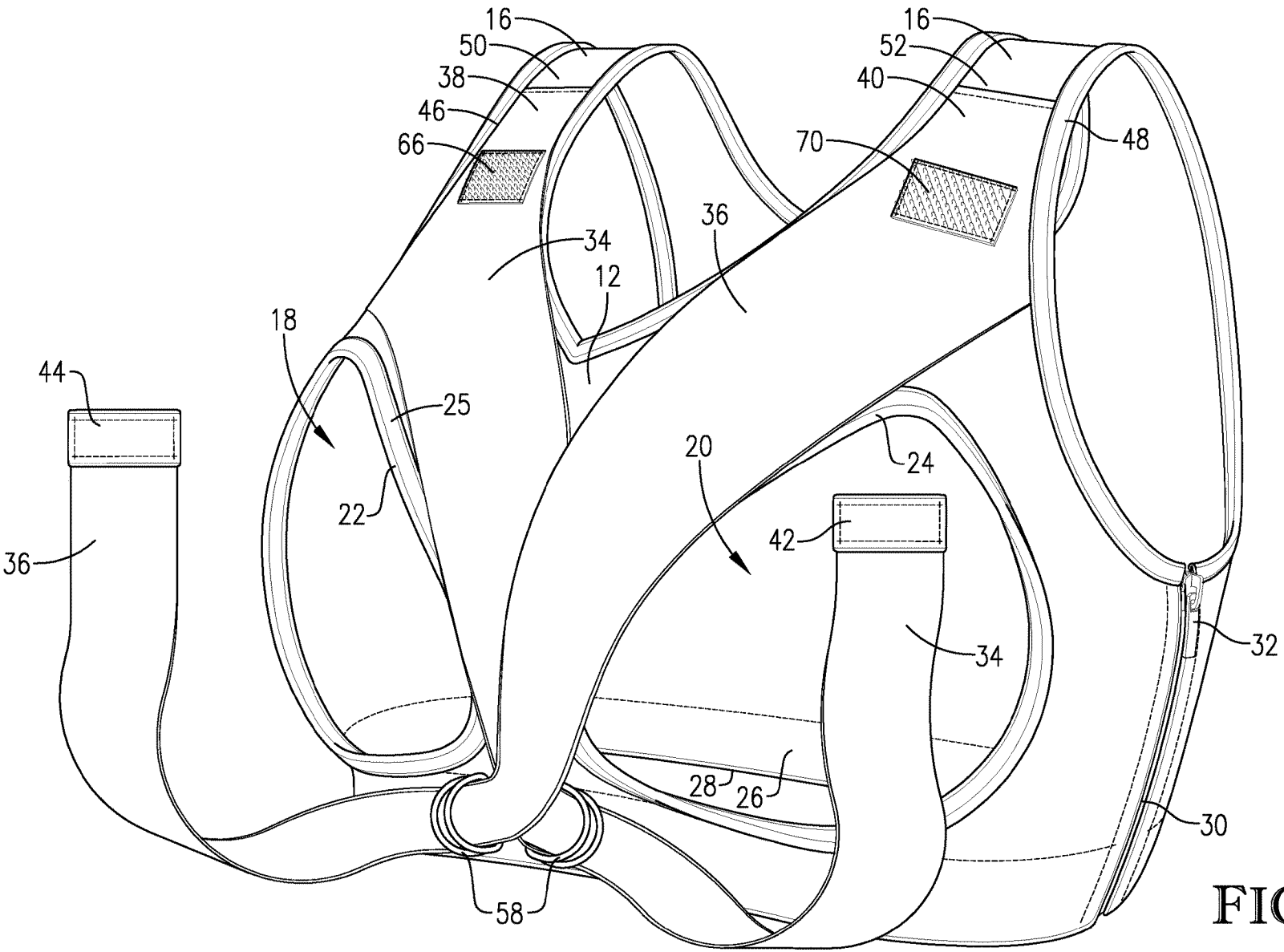
FIG. 4 is front perspective view of the supportive undergarment of FIG. 1 with the supportive straps being inserted through respective anchor members.

As shown in FIGS. 3 and 4, in certain embodiments undergarment 10 may comprise a closeable slit 30 formed at an interface between the front and back portions 12, 14, which permits easier donning and removal of undergarment 10. As illustrated, slit 30 can be closed with a zipper 32, although any fastener system known in the art, such as hook and eye fasteners, snap or button fasteners, and hook and loop fasteners, can be used.

Undergarment 10 also comprises a pair of elongate supportive strap sections 34, 36 that comprise fixed ends 38, 40 and free ends 42, 44, respectively. Fixed ends 38, 40 are secured to front portion 12, preferably in the upper region thereof, and most preferably at shoulder straps 16. In preferred embodiments, fixed ends 38 and 40 are attached to front portion outboard edges 46, 48 and lengthwise across shoulder strap lateral margins 50, 52, respectively. In certain embodiments, supportive strap sections, 34, 36 are tapered so that their widths narrow as free ends 42, 44 are approached, although this need not always be the case. In certain embodiments, the elongate support strap sections 34, 36 comprise a material that has a higher tensile strength than that of the material from which front and back portions 12, 14 are formed. Supportive strap sections 34, 36 may be formed from a single strip of fabric, or they may comprise several straps, braided straps, cords, or other similar structures.

Undergarment 10 further comprises at least one, and preferably two, anchor members 54, 56. Anchor members 54, 56 preferably are attached to the lower band 26 at locations between the breast-receiving sections 18, 20. As such, anchor members 54, 56 are configured to overlie the wearer's xiphoid process when the undergarment is being worn. As illustrated, each anchor member 54, 56 comprises a pair of D-rings 58; however, other types of fasteners could be used and still achieve the same objective. Each of the support strap sections 34, 36 are connectable to a respective anchor member, as explained below. Anchor members 54, 56 permit the support strap sections 34, 36 to be placed in tension thereby providing compressive support to the portion of the wearer's breasts that underlie upper front portion sections 60, 62.

Figure 5:
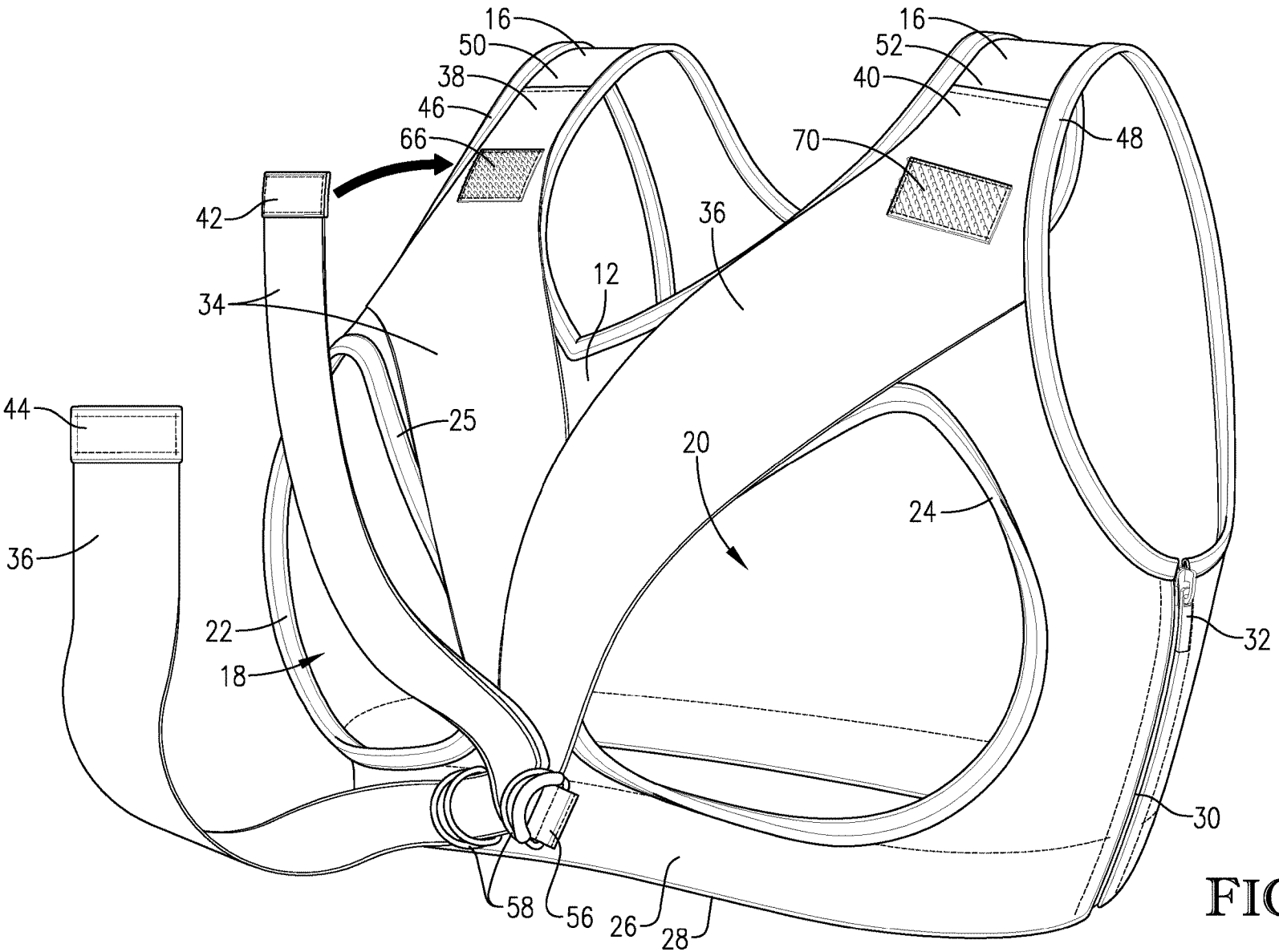
FIG. 5 is a front perspective view of the supportive undergarment of FIG. 1 with the supportive straps being placed under tension and ready for the strap free ends to be fastened to the strap proximate the strap fixed ends.

Turning to FIGS. 4 and 5, the right support strap section 34 (from the wearer's perspective) is configured to be connected to left anchor member 58 by inserting the strap section 34 through the pair of D-rings 58. Once inserted through the D-rings, the strap section 34 can be placed under the desired amount of tension, corresponding to the physical activity the wearer is contemplating, by pulling free end 42 taut. Once placed under tension, free end 42 is then fastened to a section of support strap section 34 (See FIG. 1) while maintaining the tension within the strap section. As illustrated, free end 42 and fixed end 38 may be equipped with hook and loop fastener material 64, 66, although any type of fastener known to those of skill in the art can be used. The wearer's left support strap section 36 is then connected to right anchor member 54 in a manner like that described above for strap section 34. Once attached to anchor member 54 under the desired tension, free end 44 can be secured to an area of strap section 36 with hook and loop fastening material 68, 70. It is preferred that the free end 42, 44 of each support strap section be configured to fasten to its respective support strap section at a location that is above a respective breast-receiving section 18, 20. In such embodiments, the point of attachment of free ends 42, 44 may overlie upper front portion sections 60, 62. Alternatively, the point of attachment of free ends 42, 44 may overlie fixed ends 38, 40 and/or shoulder straps 16.

Because the tension applied to strap sections 34, 36 is distributed to lower band 26 via anchor members 54, 56, lower band 26 may comprise a segment of reinforcing material in that portion of the band underlying the anchor members. Preferably, the reinforcing material is configured to add extra strength to the lower band 26 and prevent excessive and undesirable deformation of the band in this region.

In the embodiment, as illustrated in FIG. 3, back portion 14 may be configured to cover a large portion of the wearer's upper back. As explained in greater detail below, undergarment 10 is configured to be worn over a conventional bra, especially a sports bra, and back portion may be adapted to cover substantially all of the bra material overlying the wearer's back and shoulders. By configuring back portion 14 in this manner, the forces acting upon undergarment 10, and back portion 14 in particular, can be distributed over a greater surface area thereby avoiding excessive compounding of forces acting upon the wearer's back by the underlying bra, which may cause discomfort for the wearer. Likewise, it is preferable for lower band 26 to be configured so that it circumscribes the wearer's torso at a position that is below (inferior to) the lower margin of the underlying bra, and especially below any underwires associated with the bra cups. In these embodiments, it is desirable to minimize unnecessary duplication or compounding of breast-supporting forces, which could be uncomfortable for the wearer. It is noted, however, that back portion 14 need not cover a large region of or contiguous areas of the wearer's back. It is within the scope of the present invention for back portion 14 to comprise strips of fabric, braided straps, cords, or other structures that permit back portion 14 to have a fanciful design. In addition, undergarment 10 may be configured to be worn underneath a conventional bra.

In certain embodiments, the front portion 12 and the back portion 14 may be made from a nylon and spandex blend of material. In certain embodiments, the material may comprise at least 60%, 65%, 70%, 75%, or 80%, but less than 95%, 90%, 85%, or 80% nylon. In certain embodiments, the material may comprise at least 5%, 10%, 15%, or 20%, but less than 40%, 35%, 30%, or 25% spandex. In one embodiment, the fabric comprises a 72%/28% blend of nylon/spandex. It is noted that it is within the scope of the present invention for other types of fabric to be used in the construction of front portion 12 and back portion 14. Exemplary materials include those comprising neoprene, aramid fibers, and other natural and synthetic fibers. Support strap sections 34, 36 can be made of similar materials as can be used to construct the front and back portions 12, 14. However, as mentioned previously, it is preferred that the materials from which support strap sections 34, 36 are constructed have higher tensile strengths than the front and back portions 12, 14.

The supportive undergarment 10 preferably comprises one component of a system for restraining movement of breast tissue. As mentioned previously, undergarment 10 is configured to be worn over, or in certain embodiments underneath, a conventional bra, especially an underwire-containing sports bra. An exemplary system 72 is depicted in FIG. 1. A bra 74 comprising a pair of cups 76, 78 is worn against the wearer's body and provides support to the lateral sides and undersides of the wearer's breasts. The bra 74 is configured to restrain lateral and downward movement of the wearer's breasts during physical activity. Supportive undergarment 10 is configured to be worn over bra 74 and, preferably, is independent therefrom. By "independent" it is meant that undergarment 10 and bra 74 are not fastened or secured to each other. Undergarment 10 and bra 74 are configured to restrain different directions of breast tissue movement. In order to provide the best support, the forces acting upon each article should not be transmitted to the other as this could interfere with the function of each article. For example, undergarment 10 is configured to provide a compressive force to the breast tissue in a generally downward (i.e., inferior) direction, and bra 74 is configured to provide cantilevered support to the underside of the breast (i.e., in a generally upward or superior direction). If undergarment 10 and bra 74 are not independent of each other, these directionally opposite forces would be distributed across both articles thereby affecting each article's ability to function as designed. While less preferred, it is within the scope of the present invention for undergarment 10 and bra 74 to be connected in some limited manner. However, such connections should be provided in a manner that is least likely to interfere with the function of each article and still permit substantial independent movement of the undergarment and bra.

As can be seen in FIG. 1, breast-receiving sections 18, 20 overlie the bra cups 76, 78 and, when sections 18, 20 comprise cutouts, permit the cups to extend therethrough.

Since bra 74 preferably restrains downward and lateral (side-to-side) breast movement, in certain embodiments front panel 12 provides less support to the lateral and medial sides and undersides of the wearer's breasts than does bra 74. This feature permits front portion 12 to be constructed from a more stretchable material and reduces the likelihood of creating pressure points on the wearer's body through the compounding of breast-supporting forces.

Certain bras, like underwire-containing bra 74, are configured to impart desired aesthetic qualities to the wearer's breasts, giving the breast a certain shape. Because undergarment 10 only restrains the upward movement of the wearer's breast tissue, undergarment 10 preferably does not interfere with the bra's functionality in this regard and does not alter the shape given to the wearer's breasts by the bra.

In use, the wearer dons supportive undergarment 10 over bra 74. However, as described above, it is within the scope of the present invention for undergarment 10 to be worn underneath bra 74. Preferably, lower band 26 is positioned below the cups of bra 74, and if underwires are present, lower band 26 ought to be worn below and not on top (or directly under) of the underwires. The wearer then extends one of the supportive strap sections 34 over the upper portion of one of the wearer's breasts toward anchor member 56, and the other supportive strap section 36 toward anchor member 54. Each of the supportive strap sections 34, 36 is attached to its respective anchor member 56, 54. In particular, free end 42 is passed through D-rings 58 of anchor member 56, and free end 44 is passed through D-rings 58 of anchor member 54. The wearer then pulls on each strap section 34, 36 to apply a tensile force that compresses the upper portions of the wearer's breasts (i.e., the upper breast root). The anchor members 54, 56 function to maintain the tensile force within the strap sections 34, 36 even though the wearer is no longer actively pulling on the straps and to transfer those forces into the lower band 26. The free ends 42, 44 of each strap section are fastened onto a section of the respective strap section, preferably at a location above the breast-receiving sections 18, 20. The fasteners 64-70 help maintain the tension within strap sections 34, 36 by keeping the strap section and anchor member connection from loosening. The compression applied to the upper breast root by strap section 34, 36 arrests upward movement of the wearer's breast tissue while the wearer is engaged in physical activity. Bra 74 provides cantilevered support to the underside of the wearer's breasts thereby restraining downward breast movement. In addition, bra 74 may be configured to restrain lateral breast motion by providing support to the lateral and medial sides of the wearer's breasts.

Figure 6:
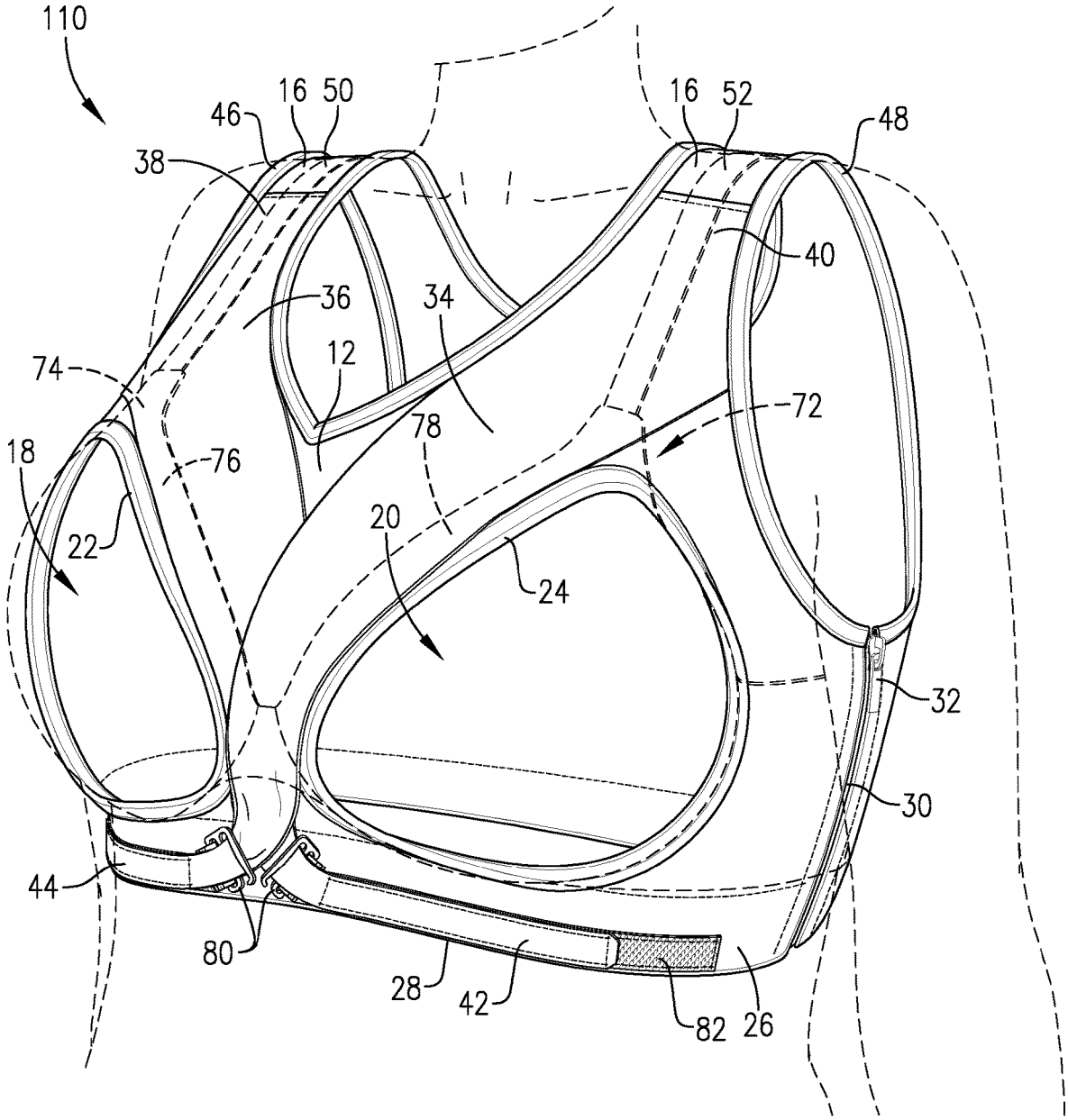
FIG. 6 is a front perspective view of an alternative embodiment of the present invention in which the free ends of the supportive straps are fastened atop the supportive undergarment lower band.
Figure 7:
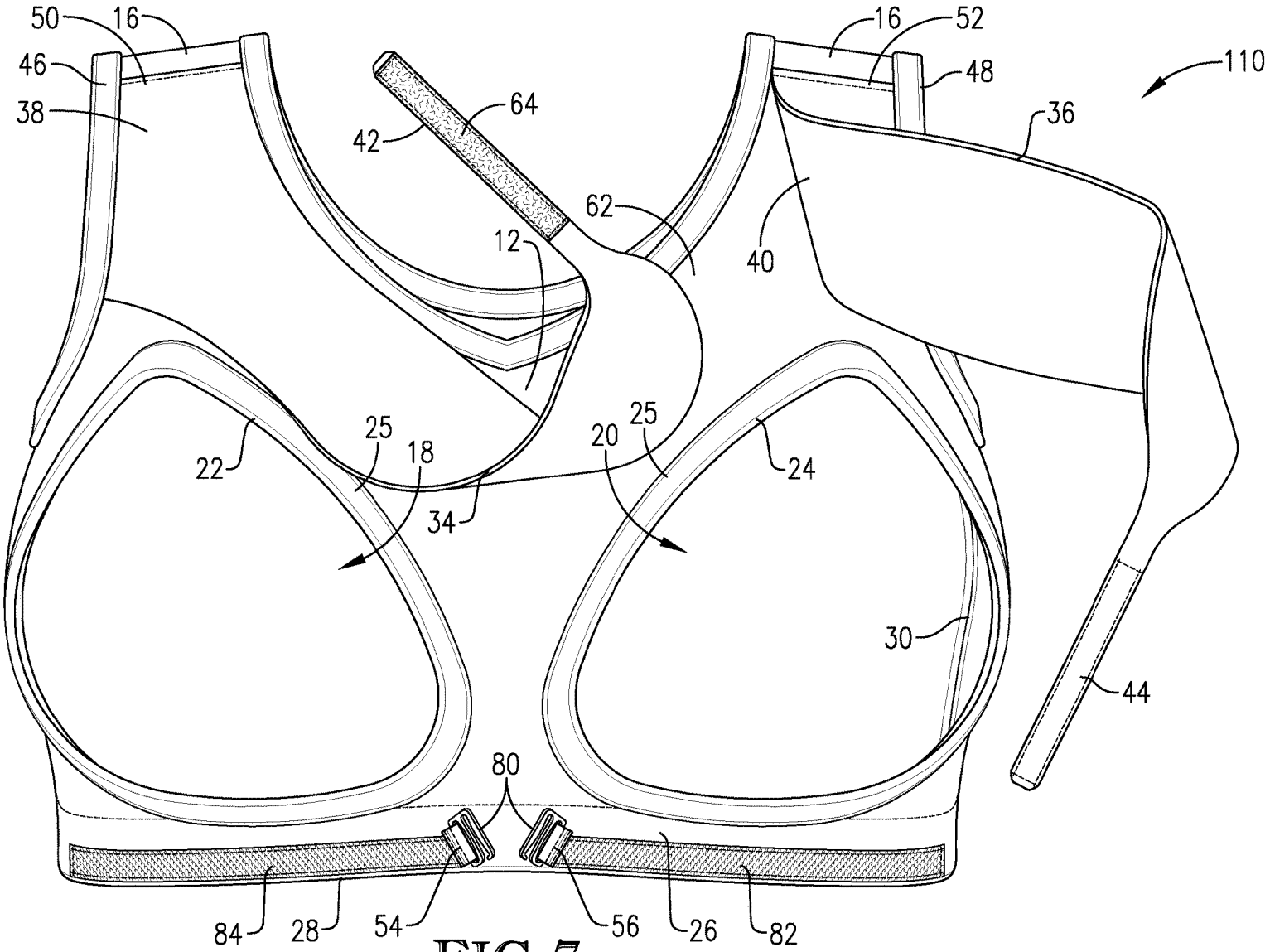
FIG. 7 is a front view of the supportive undergarment of FIG. 6 with the supportive straps unsecured.
Figure 8:
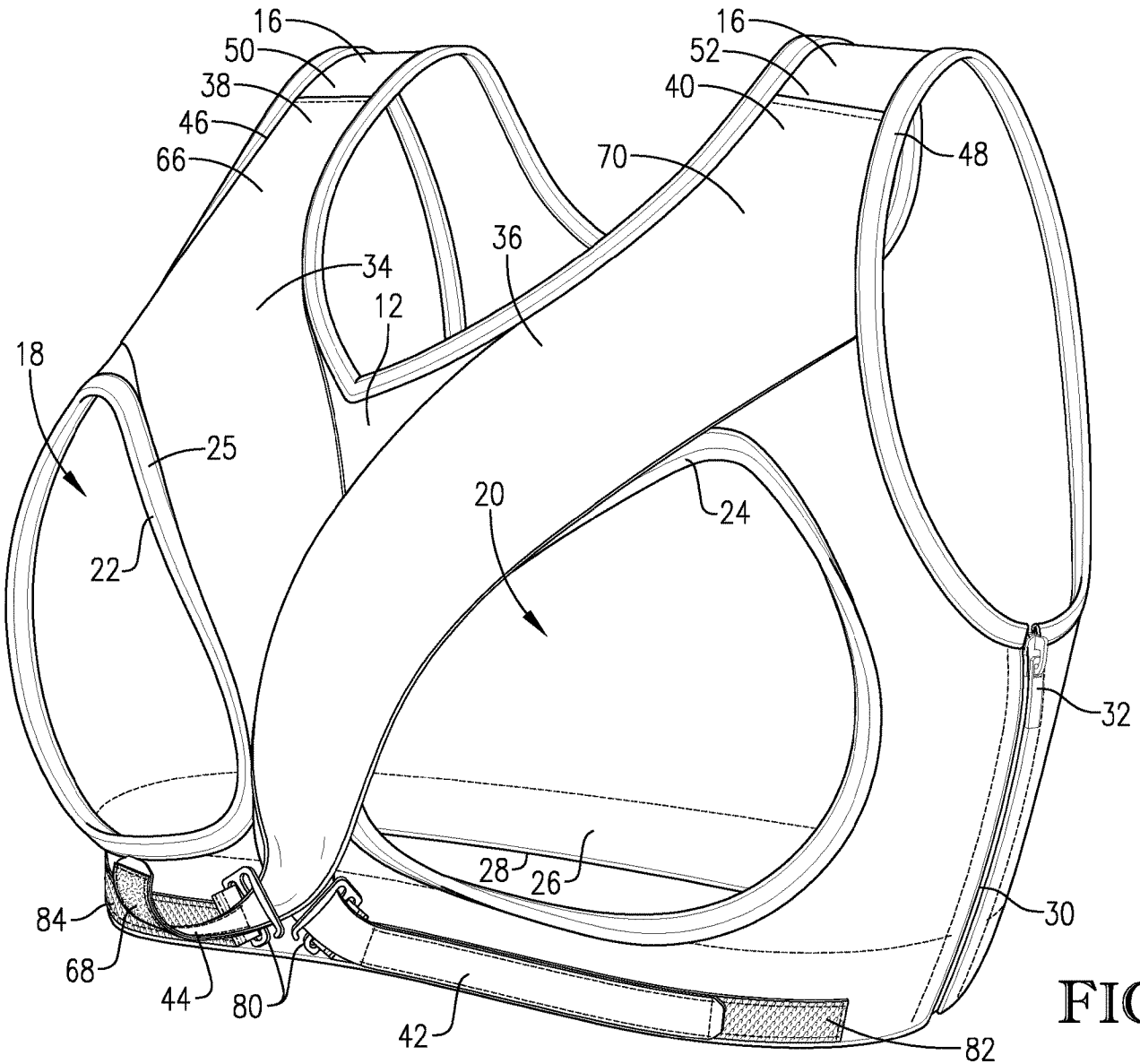
FIG. 8 is a front perspective view of the supportive undergarment of FIG. 6 with one of the supportive straps secured to the lower band.

FIGS. 6-8 depict another embodiment of a supportive undergarment 110 made in accordance with the present invention. This embodiment is similar to that illustrated in FIGS. 1-5 in many respects, and for expediency, only the differences between the embodiments are discussed below. Common elements between the two embodiments bear the same reference numbers. In this embodiment, the support strap sections 34, 36 are secured to the lower band 26 rather than being secured to themselves at a location that is above breast receiving sections 18, 20. Undergarment 110 is equipped with a pair of hooks 80 located in a similar position as D-rings 58 from the previous embodiment. Each supportive strap section is passed through a respective hook 80, which is located opposite the side of the fixed end 38, 40 of the strap section, and then fastened to lower band 26 underneath a respective breast receiving section 18, 20 using, for example, a hook fastener material 82, 84. Thus, in use, the wearer anchors the supportive strap sections 34, 36 to the lower band 26 at two locations (i.e., hooks 80 and fastener 82), while placing the strap sections in tension to provide a compressive force to the wearer's upper breast. By anchoring the strap sections in these locations, the tendency for the lower band to ride up the wearer's torso is lessened and a more secure, comfortable fit for garment 110 is provided.

As illustrated, supportive undergarment 110 is worn over a conventional bra 72. However, it is within the scope of the present invention for undergarment 110 to be worn underneath bra 72 up against the wearer's skin. In addition, breast-receiving sections 18, 20 may comprise fabric panels or cutouts (as illustrated).

Figure 9:
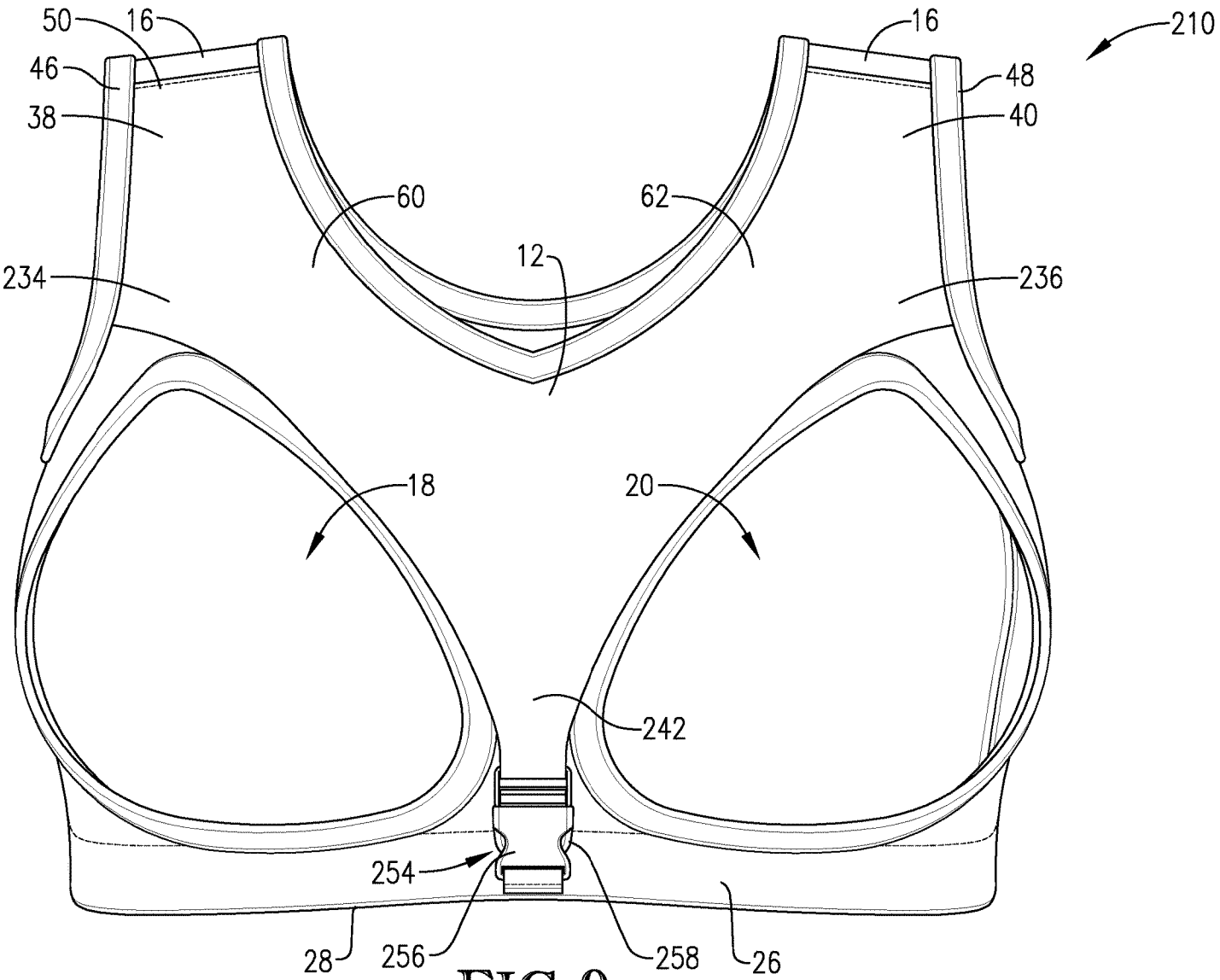
FIG. 9 is a further embodiment of the present invention in which the supportive straps extending across the upper margin of the wearer's breasts are anchored to the supportive undergarment's lower band using a single fastener.

FIG. 9 illustrates a further embodiment of a supportive undergarment 210 made in accordance with the present invention. Undergarment 210 is similar in many respects to undergarments 10, 110 described above. Therefore, for the sake of expedience, only the relevant differences between the embodiments are discussed below. Undergarment 210 comprises supportive strap sections 234, 236 that are configured to restrain upward movement of the wearer's breasts much like strap sections 34, 36 described above. However, instead of each strap section comprising a free end that is independently connectable to an anchor member, strap sections 234, 236 are connectable to a common anchor member 254 via a common strap segment 242. As illustrated, anchor member 254 comprises a buckle 256 into which a latch 258 may be inserted. One or both of buckle 256 and latch 258 may be adjustable so that the amount of tension placed upon strap sections 234, 236 can be varied according to the wearer's preferences. Alternatively anchor member 254 may comprise a hook similar to hook 80 illustrated in FIGS. 6-8, and the distal end of strap segment 242 may comprise a loop, which can be fixed or adjustable.

In certain embodiments, supportive undergarment 210 may be configured to be worn underneath a conventional bra 74. In such embodiments, it is preferable for breast-receiving sections 18, 20 to comprise a fabric panel, although this need not always be the case and breast-receiving sections 18, 20 may also comprise cutouts. Supportive undergarment 210 may also be configured to be worn over a conventional bra 74 like the above-described embodiments.

I claim:

1. A supportive undergarment comprising:

a pair of breast-receiving sections;

a front panel further comprising:

a pair of chest segments extending directly above the pair of breast receiving sections, respectively;

a pair of shoulder straps that extend upwardly from the pair of chest segments, respectively, that are configured to overlie a wearer's shoulders; and a medial segment that extends between the pair of breast-receiving sections;

a pair of support strap sections, each support strap section comprising a fixed end that is attached to a respective shoulder strap of the pair of shoulder straps, and a free end;

wherein each support strap section is movable between a first configuration in which the support strap section engages a corresponding chest segment of the pair of chest segments and engages the medial segment, and a second configuration in which the support strap section does not engage the corresponding chest segment and does not engage the medial segment;

a back portion configured to overlie the wearer's back;

a lower band attached to the front panel and the back portion at a lower margin of the front panel and the back portion, the lower band being positioned beneath the pair of breast-receiving sections and configured to circumscribe at least a portion of the wearer's rib cage; and at least one anchor member attached to the lower band at a location that is in between the pair of breast-receiving sections, the pair of the support strap sections being connectable to the at least one anchor member under tension.

2. The supportive undergarment of claim 1, wherein the undergarment further comprises a closeable slit located at an interface between the front panel and the back portion.

3. The supportive undergarment of claim 1, wherein the support strap sections comprise a material having a higher tensile strength than that of the front panel and the back portion.

4. The supportive undergarment of claim 1, wherein the free end of each support strap section is configured to be fastened to the respective support strap section at a location that is above one of the breast-receiving sections.

5. The supportive undergarment of claim 1, wherein each support strap section comprises a the free end of each support strap section is configured to be fastened to a respective fastener overlying the lower band underneath and located beneath a respective breast-receiving section.

6. The supportive undergarment of claim 1, wherein the support strap sections are configured to be attached to the at least one anchor member through a common strap segment that is attached to the pair of support strap sections.

7. The supportive undergarment of claim 1, wherein the lower band comprises a material having a higher tensile strength than that of the front panel and the back portion.

8. The supportive undergarment of claim 1, wherein the undergarment is adapted to be worn over an underwire-containing bra.

9. The supportive undergarment of claim 1, wherein the undergarment is adapted to be worn underneath an underwire-containing bra.

10. The supportive undergarment of claim 1, wherein the support straps sections, when connected to the at least one anchor member, are configured to arrest upward movement of the wearer's breast tissue.

11. The supportive undergarment of claim 1, wherein the lower band comprises a reinforced segment to which the at least one anchor member is attached.

12. The supportive undergarment of claim 1, wherein the at least one anchor member is configured to overlie the wearer's xiphoid process.

13. The supportive undergarment of claim 1, wherein each of the breast-receiving sections comprises a cutout that is configured to overlie one of the wearer's breasts.

14. A system for restraining movement of breast tissue, the system comprising:

a bra comprising a pair of cups and configured to provide support to lateral sides and undersides of a wearer's breasts and restrain lateral and downward movement thereof; and a supportive undergarment that is substantially independent of and configured to overlie or underlie the bra and is configured to restrain upward movement of the wearer's breasts, the supportive undergarment comprising:

a pair of breast-receiving sections;

a front panel further comprising:

a pair of chest segments extending directly above the pair of breast receiving sections, respectively;

a pair of shoulder straps that extend upwardly from the pair of chest segments, respectively, that are configured to overlie a wearer's shoulders; and a medial segment that extends between the pair of breast-receiving sections;

a pair of support strap sections, each support strap section comprising a fixed end that is attached to a respective shoulder strap of the pair of shoulder straps, and a free end;

wherein each support strap section is movable between a first configuration in which the support strap section engages a corresponding chest segment of the pair of chest segments and engages the medial segment, and a second configuration in which the support strap section does not engage the corresponding chest segment and does not engage the medial segment;

a back portion configured to overlie the wearer's back;

a lower band attached to the front panel and the back portion at a lower margin of the front panel and the back portion, the lower band being positioned beneath the pair of breast-receiving sections and configured to circumscribe at least a portion of the wearer's rib cage; and at least one anchor member attached to the lower band at a location that is in between the pair of breast-receiving sections, the pair of the support strap sections being connectable to the at least one anchor member under tension.

15. The system of claim 14, wherein the front panel provides less support to the lateral sides and undersides of the wearer's breasts than does the bra.

16. The system of claim 14, wherein the supportive undergarment does not alter the shape given to the wearer's breasts by the bra.

17. The system of claim 14, wherein the bra comprises an underwire associated with each cup.

18. The system of claim 17, wherein the lower band is configured to be worn below the bra underwires.

19. The system of claim 18, wherein the lower band has a higher tensile strength than that of the front panel.

20. The system of claim 14, wherein the pair of support strap sections have a higher tensile strength than that of the front panel.

21. A method of restraining movement of breast tissue, the method comprising:

donning a supportive undergarment over or underneath a bra, the supportive undergarment comprising:

a pair of breast-receiving sections;

a front panel further comprising:

a pair of chest segments extending directly above the pair of breast receiving sections, respectively;

a pair of shoulder straps that extend upwardly from the pair of chest segments, respectively, that are configured to overlie a wearer's shoulders; and a medial segment that extends between the pair of breast-receiving sections;

a pair of support strap sections, each support strap section comprising a fixed end that is attached to a respective shoulder strap of the pair of shoulder straps, and a free end;

wherein each support strap section is movable between a first configuration in which the support strap section engages a corresponding chest segment of the pair of chest segments and engages the medial segment, and a second configuration in which the support strap section does not engage the corresponding chest segment and does not engage the medial segment;

a back portion configured to overlie the wearer's back;

a lower band attached to the front panel and the back portion at a lower margin of the front panel and the back portion, the lower band being positioned beneath the two breast-receiving sections and configured to circumscribe at least a portion of the wearer's rib cage; and at least one anchor member attached to the lower band at a location that is in between the two breast-receiving sections, and the fixed ends being attached to the front panel at opposed outboard margins thereof and above the breast-receiving sections;

extending the support strap sections over upper portions of the wearer's breasts; and anchoring the support strap sections to the at least one anchor member while the support strap sections are under tension, thereby providing compression to the upper portions of the wearer's breasts.

22. A supportive undergarment comprising:

a front portion having a pair of breast-receiving sections configured to overlie at least a portion of a wearer's breasts;

a back portion configured to overlie the wearer's back;

a lower band attached to the front and back portions at a lower margin of the front and back portions, the lower band being positioned beneath the pair of breast-receiving sections and configured to circumscribe at least a portion of the wearer's rib cage;

at least one anchor member attached to the lower band at a location that is in between the pair of breast-receiving sections; and a pair of support strap sections that are unattached to the pair of breast-receiving sections, each of the support strap sections having a fixed end that is secured to the front portion by first and second seams, the first seam extending horizontally across a shoulder strap, the second seam extending transversely to the first seam adjacent to an arm opening defined cooperatively by the front and back portions, the pair of the support strap sections being connectable to the at least one anchor member under tension.

* * * * *